US009338875B2

(12) United States Patent
Chen et al.

(10) Patent No.: US 9,338,875 B2
(45) Date of Patent: May 10, 2016

(54) INTERLACED MULTI-ENERGY BETATRON WITH ADJUSTABLE PULSE REPETITION FREQUENCY

(71) Applicant: Varian Medical Systems, Inc., Palo Alto, CA (US)

(72) Inventors: Gongyin Chen, Henderson, NV (US); Robert Drubka, Scottsdale, AZ (US)

(73) Assignee: Varian Medical Systems, Inc., Palo Alto, CA (US)

( * ) Notice: Subject to any disclaimer, the term of this patent is extended or adjusted under 35 U.S.C. 154(b) by 253 days.

(21) Appl. No.: 13/961,831

(22) Filed: Aug. 7, 2013

(65) Prior Publication Data

US 2015/0043717 A1 Feb. 12, 2015

(51) Int. Cl.
*H05H 11/04* (2006.01)

(52) U.S. Cl.
CPC ..... *H05H 11/04* (2013.01)

(58) Field of Classification Search
CPC ..... H05H 11/04; H05H 2007/085; H05H 2007/087
See application file for complete search history.

(56) References Cited

U.S. PATENT DOCUMENTS

2006/0249685 A1* 11/2006 Tanaka ..... 250/397
2010/0150312 A1* 6/2010 Chen ..... H01J 35/00 378/121
2011/0284761 A1* 11/2011 Balakin ..... A61N 5/10 250/396 R

* cited by examiner

*Primary Examiner* — Hoon Song
(74) *Attorney, Agent, or Firm* — David B. Raczkowski; Kilpatrick Townsend & Stockton LLP

(57) ABSTRACT

Variable pulse frequency during an output session of a betatron device and adjustable energy from pulse to pulse are provided. A different bias magnetic field may be used for different cycles of an output session, thereby providing different pulse energies. In one example, the bias field can be switched from a positive value to zero, with energy stored in a storage device when the bias field is zero. The bias field can also be used to expand electrons from a stable orbit when the bias field is decreased. For variable pulse frequency, when a current in the swing coils decreases to zero, the swing coils can be disengaged from a storage device for an adjustable time before re-engaging for a next cycle, thereby adjusting the frequency. In addition, radiation dose output can be adjusted by varying a length of time for the injection of electrons into a betatron.

35 Claims, 11 Drawing Sheets

300

A

Field and flux coil circuit

500

550

B

Bias coil circuit

900

INTERLACED MULTI-ENERGY BETATRON WITH ADJUSTABLE PULSE REPETITION FREQUENCY

BACKGROUND

Betatrons can be used to accelerate electrons and produce x-ray radiation for large object inspection purpose. Electrons are injected from a gun and then accelerated when circulating near a fixed-radius orbit. In inspection applications, electrons are typically accelerated to several MeV and then extracted as a pulse to hit a metal target to produce x-rays. The x-rays can be used to for cargo inspection.

However, typical betatrons provide only a single energy during an output session. To provide a different energy, a new session with different parameters or a different betatron device would need to be used. Whereas, linear accelerators that provide electron pulses of different energy from pulse to pulse have been developed in recent years. These different energies can provide additional information for inspection purposes.

A betatron typically operates at up to 300 or 400 pulses per second. But, the frequency during an output session would be a fixed value. Again, to provide a different energy, a new session with different parameters or a different betatron device would need to be used. Thus, traditional betatrons have the following disadvantages: the pulse frequency is not readily adjustable, the electron energy is not readily switchable from pulse to pulse, energy for expansion action is not recovered, and radiation output is not controllable from pulse to pulse.

Therefore, it is desirable to have methods and betatron devices that can provide adjustable pulse frequency and provide electron energy that is adjustable from pulse to pulse, as well as other advantages.

BRIEF SUMMARY

Embodiments can provide variable pulse frequency during an output session of a betatron device and adjustable energy from pulse to pulse. According to one embodiment, a different bias magnetic field may be used for different cycles of an output session, thereby providing different pulse energies when the bias magnetic field is different between cycles. In one example, the bias field can be switched from a positive value to zero, with energy stored in a storage device (e.g., a capacitor) when the bias field is zero. The bias field can also be used to expand electrons from a stable orbit when the bias field is decreased.

According to another embodiment, for variable pulse frequency, the magnetic energy of field and flux swing coils can be recovered and stored in a storage device. When a current in the swing coils decreases to zero, the swing coils can be disengaged from the storage device for an adjustable amount of time. After the delay, the storage device can be re-engaged to produce a next cycle for the oscillating field and flux. In addition, radiation dose output can be adjusted by varying a length of time for the injection of electrons into a betatron.

A better understanding of the nature and advantages of embodiments of the present invention may be gained with reference to the following detailed description and the accompanying drawings.

DETAILED DESCRIPTION

Variable pulse frequency during an output session of a betatron device and adjustable energy from pulse to pulse are provided. A different bias magnetic field may be used for different cycles of an output session, thereby providing different pulse energies. In one example, the bias field can be switched from a positive value to zero, with energy stored in a storage device when the bias field is zero. The bias field can also be used to expand electrons from a stable orbit when the bias field is decreased. For variable pulse frequency, when a current in the swing coils decreases to zero, the swing coils can be disengaged from a storage device for an adjustable time before re-engaging for a next cycle, thereby adjusting the frequency. In addition, radiation dose output can be adjusted by varying a length of time for the injection of electrons into a betatron.

Accordingly, various embodiments can recover magnetic field energy (less loss to ohm heating, eddy current and hysteresis) in a storage device. The storage device can hold the energy for an adjustable delay, thereby providing a delay in cycles to control pulse frequency. The manipulation of the bias field can achieve interlaced dual energy acceleration cycles to provide different energy pulses. The field bias coil can also be used as an expansion coil.

I. Introduction

A. Basic Operation

Figure 1:
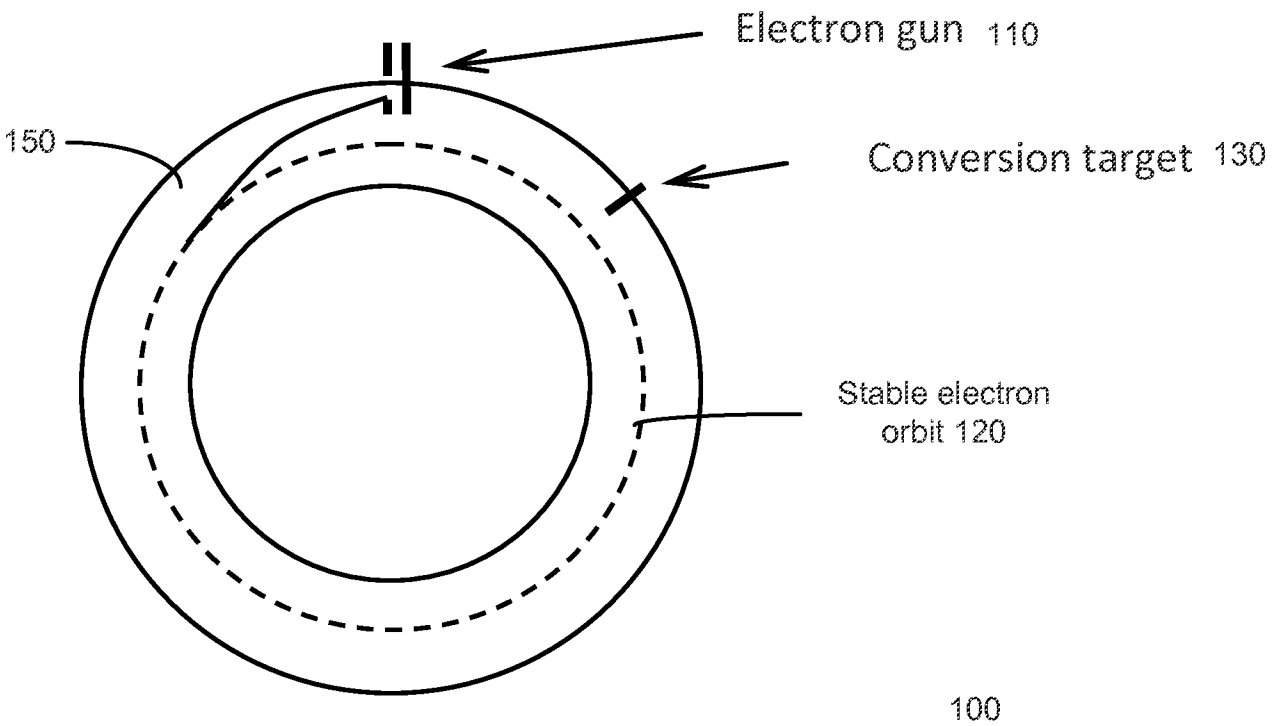
FIG. 1 is a top view of a betatron device 100 according to embodiments of the present invention.

FIG. 1 is a top view of a betatron device 100 according to embodiments of the present invention. Electron gun 110 injects electrons into of vacuum enclosure 150. Electrons can be injected as a packet. A stable electron orbit 120 is shown.

After injection, the electrons can be accelerated by a swing flux that is generated by swing coils. The swing flux is a swing in magnetic flux within orbit 120. The electrons are also subject to (confined to the circular orbit by) the total magnetic field that is generated by swing coils, and potentially other coils (e.g., bias coils). The magnetic core of the betatron device can be used to amplify and shape the magnetic fields resulting from the coils. The result is a stable electron orbit 120 that satisfy the betatron condition (described below).

Once the packet of electrons have been accelerated to a peak energy, the magnetic field at the stable electron orbit 120 can be reduced while keeping the flux within the orbit the same, thereby breaking the betatron condition. Without the betatron condition, the electrons expand their orbit and hit conversion target 130 to produce x-rays.

Betatrons accelerate electrons in a toroid-shaped vacuum tube (e.g., enclosure 150). A magnetic field at the electron orbit provides a Lorentz force (centripetal force) that counters electrons' centrifugal force so that electrons circulate on the mid radius. Should magnetic flux inside the orbit increase, electrons will be accelerated and gain momentum (therefore energy). A betatron device is designed such that magnetic field at the electron orbit increases with magnetic flux in lock-step and maintains the so called betatron condition:

$$d/dtB_z(R)=d/dt\phi/(2\pi R^2).$$

The axial magnetic field component at the electron orbit increases at half the rate of the average magnetic field inside the orbit.

Upon injection, the electrons can have an initial condition for initial energy, and therefore momentum. Electrons are usually injected with an electron gun at relatively low energy (therefore low momentum) at low magnetic field intensity. To perform axial focusing, a magnet tip of the betatron can provide a magnetic field component that focuses electrons onto the orbit plane. Such magnetic field component would be zero in the orbit plane, increases with offset from the plane, and points to the center axis of the electron orbit.

Due to this tapping, axial magnetic field $B_z(R)$ decreases with radius. Thus, the axial magnetic field component is lower at larger radius. As a radial stability condition, the axial magnetic field should not go down (at larger radius) faster than centrifugal force. The centrifugal force is proportional to R; therefore, $B_z(R)$ should not reduce faster than 1/R.

For expansion and extraction, when magnetic field and flux reach the maximum, magnetic field at the orbit can be reduced so that electron orbit will expand and hit a metal target (e.g., target 130) on the outside edge of the toroid tube. Ideally magnetic flux would not have changed significantly so that electrons can maintain their momentum (and therefore energy).

In a Betatron, there are swing coils (more than one winding so all qualify as coils) to produce a swing in magnetic field (swing field or swing component) at the electron orbit and a swing in magnetic flux (swing flux) inside the electron obit, with the rate of change satisfying the betatron condition. In addition, there are expansion coils to change the magnetic field at the electron orbit at the end of each acceleration cycle so that electrons are extracted, ideally without significant energy change in the process.

There are many variations of actual coil windings. For instance, field coils can produce the required swing field and use separate flux coils to produce the required swing flux, e.g., where flux windings are close to the axis. A smaller radius means shorter wires and smaller ohm heating loss, which is an advantage for high energy betatrons. Embodiments can combine bias field coils with expansion coils for simplicity. The operation of the field and flux is now described.

B. Field and Flux vs. Time

As described, change in magnetic flux inside electron orbit accelerates electrons and total axial magnetic field at electron orbit confines electron to the circular orbit. For simplicity we use magnetic flux for magnetic flux inside electron orbit and magnetic field for axial magnetic field at electron orbit in the following text.

Figure 2:
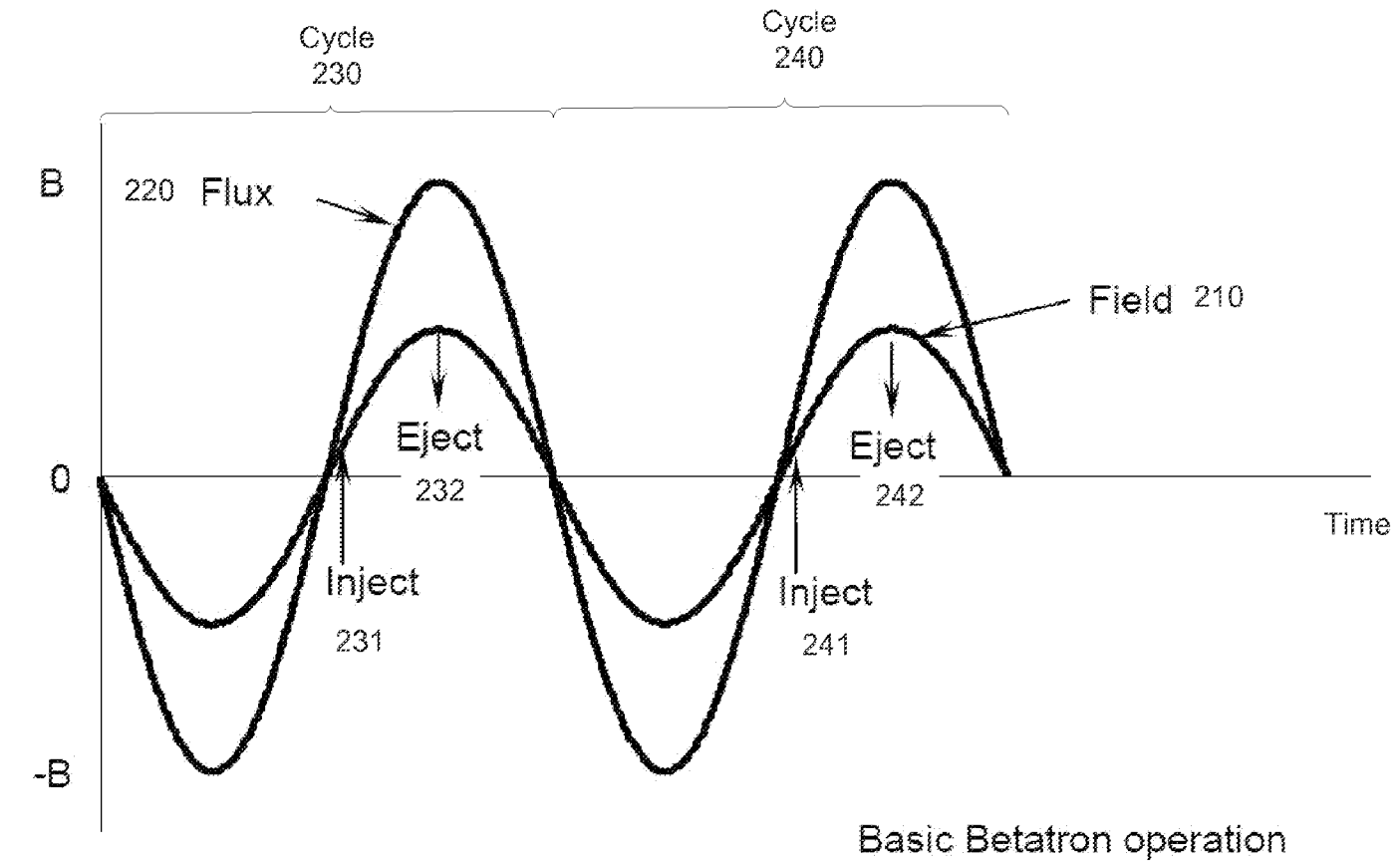
FIG. 2 shows a plot 200 of the change in magnetic field 210 and magnetic flux 220 over time for the basic operation of a betatron.

FIG. 2 shows a plot 200 of the change in magnetic field 210 and magnetic flux 220 over time for the basic operation of a betatron. Plot 200 shows a magnetic effect of driving the swing coils with an oscillating signal. The horizontal axis is time. The vertical axis shows a magnitude of the magnetic flux and field.

Magnetic field 210 is the field at the electron orbit from the swing coils. Thus, magnetic field 210 provides the Lorentz force for keeping the electrons in the stable electron orbit. Magnetic field 210 shows an oscillating waveform as a result of the swing coils being driven by an oscillating signal (e.g., an oscillating voltage). Magnetic flux 220 is the flux through the electron orbit resulting from magnetic field 210. As one can see, magnetic flux 220 has the same frequency as magnetic field 210, but with a higher amplitude.

Two cycles of magnetic fields 210 and magnetic flux 220 are shown. Cycle 230 is the first cycle shown. Cycle 240 is the second cycle shown. Given that magnetic field 210 is oscillating from a negative value to a positive value, only part of a cycle can be used. Since the electrons are to be accelerated in a particular direction to achieve a maximum energy, the portion of the cycle with a positive field and an increasing flux is used.

For cycle 230, a first packet of electrons is injected at time 231 and ejected at time 232. The electrons are ejected at time 232 as that is the maximum of field 210, and if the electrons were to remain in the orbit, then the electrons would begin to slow down since the flux is now decreasing.

Cycle 240 begins immediately after cycle 230 ends. The first half of cycles 240 is not used as then the electrons would be accelerated in the wrong direction. A second packet of electrons is injected at time 241 and ejected at time 242. Both packets of electrons provide pulses of equal energy.

These cycles of operation can be considered an output session. A single output session can be characterized by the use of the same hardware to create the driving signal for the multiple cycles. The amplitudes for the cycles would be at the same energy, and the injection and ejection would be at the same points in ach cycle. One could change the hardware (e.g., the power supply) to get a new pulse energy, but then that would not be during a same output session, and thus is not convenient and would be costly. One could delay the time of injection to obtain a lower energy for a given cycle by introducing a negative bias magnetic field, but this is not typically possible from pulse to pulse (cycle to cycle). And, one typically cannot inject electrons at a later time, as then the field would be larger than field required for containing initial electrons, which are injected at tens of keV.

C. Bias Field

Some betatron designs use a magnetic field bias so that the full flux swing of a cycle can be used for electron acceleration. In such design, a steady state magnetic field can be added. The combined magnetic field of the steady state field (also called bias component) and the swing component cross zero near the bottom of each flux (and field) swing cycle. The electrons can be injected at this time instead of waiting for the swing component to cross zero. Since the length of the acceleration portion (magnetic flux swing between injection and ejection) approximately doubles, electrons can be accelerated to approximately double the energy. The total magnetic field can include the bias component and the swing component.

Figure 3:
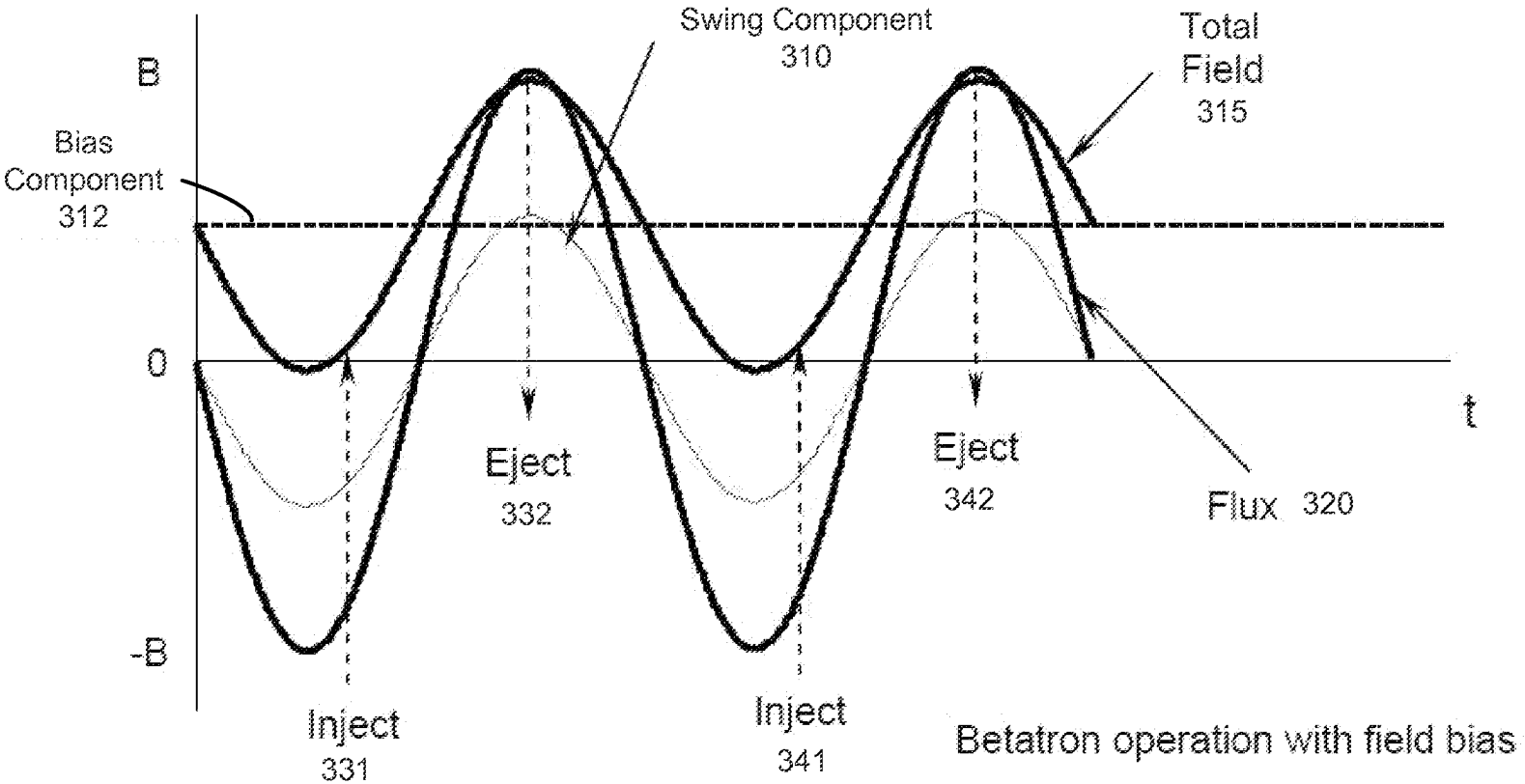
FIG. 3 shows a plot 300 of the change in total magnetic field 315, including a swing component 310 and a bias component 312, over time for a bias operation of a betatron.

FIG. 3 shows a plot 300 of the change in total magnetic field 315, including a swing component 310 and a bias component 312, over time for a bias operation of a betatron. Plot 300 shows the same magnetic effect of driving the swing coils with an oscillating current. The horizontal axis is time. The vertical axis shows a magnitude of the magnetic flux and field.

A constant magnetic field at the electron orbit is introduced as a bias component 312 during the cycles. Swing component 310 is the field at the electron orbit from the swing coils. The total field 315 includes swing component 310 and bias component 312. Total field 315 provides the Lorentz force for keeping the electrons in the stable electron orbit.

Total field 315 shows an oscillating waveform as a result of the swing coils being driven by an oscillating signal, but the waveform is shifted up as a result of bias component 312. Magnetic flux 320 is not affected by bias component 312, as it is constant during the cycles. Since total field 315 is biased in the positive direction, a greater portion of total field 315 is positive. Thus, a greater portion of a cycle has a magnetic flux swing that is used for accelerating the electrons.

For the first cycle, a first packet of electrons is injected at time 331 and ejected at time 332. As one can see, the injection at time 331 occurs earlier in a cycle than for plot 200. Thus, the electrons can be accelerated through a larger portion of magnetic flux swing and achieve a higher energy. Note that the electrons are still ejected at time 332 as that is the maximum of total field 315.

For the second cycle, an initial portion of the cycle is still not used. A second packet of electrons is injected at time 341 and ejected at time 342. Both packets of electrons provide pulses of equal energy, which is higher than the pulses achieved in plot 200.

D. Traditional Operation

Regarding the pulse frequency, field intensity is set up to oscillate continuously, as shown in waveforms in the previous section. Oscillation frequency (and therefore x-ray pulse repetition frequency, PRF) is determined by hardware design and not readily adjustable. On the other hand, inspection applications need flexibility of selecting PRF or even adjusting PRF in real time.

Regarding electron energy being switched from pulse to pulse, electrons are injected when the magnetic field is appropriate for the injection energy, which is soon after the field crosses zero. Electrons are ejected when the magnetic flux and magnetic field reach the peak value, and the energy cannot be varied from pulse to pulse. And, energy is not optimally recovered, which wastes energy and also produces more heat in the system.

II. System

A. Betatron and Coils

Figure 4:
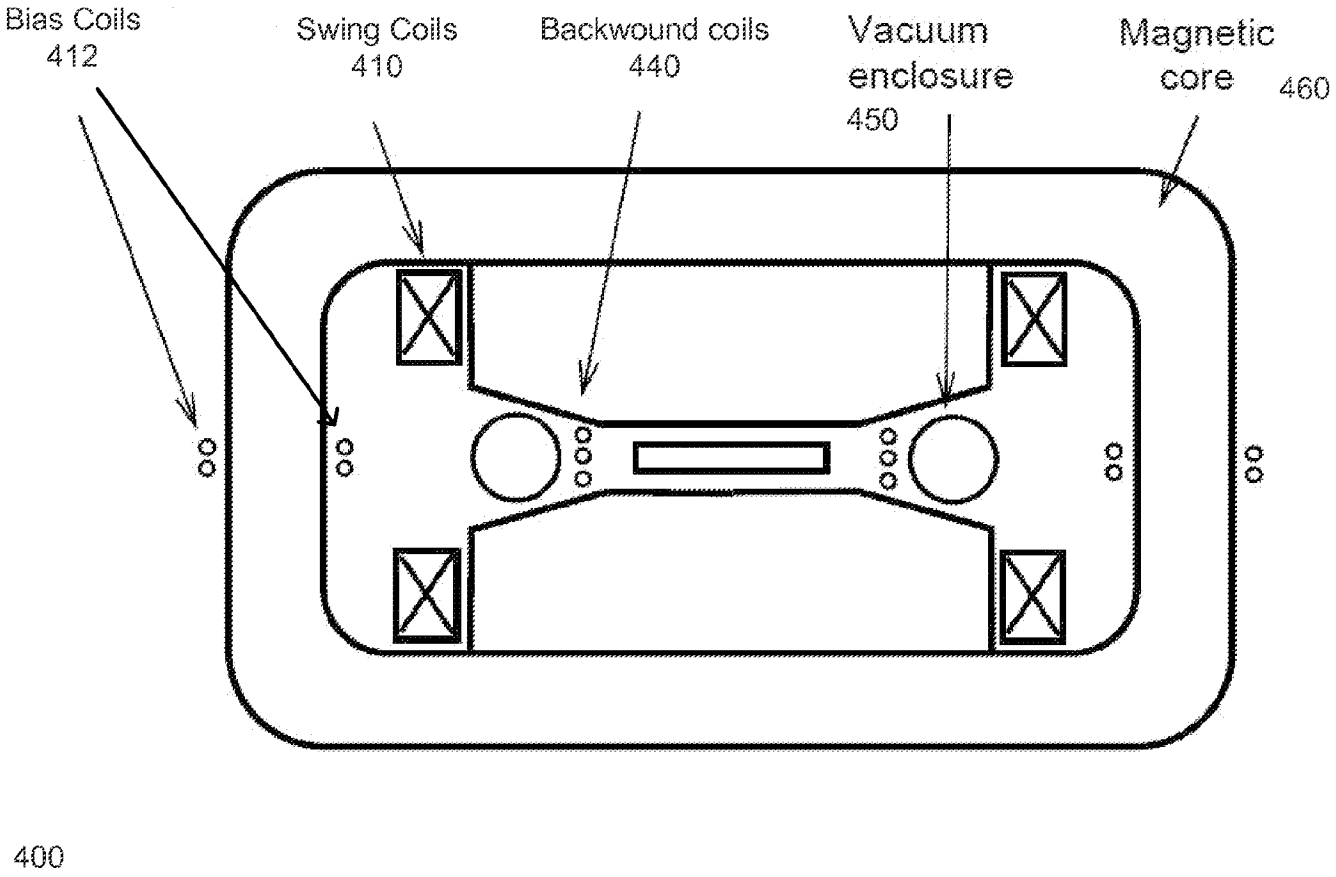
FIG. 4 is a side view of a betatron device 400 according to embodiments of the present invention.

FIG. 4 is a side view of a betatron device 400 according to embodiments of the present invention. A toroidal-shaped vacuum enclosure 450 is placed within a magnetic core 460. Electrons are injected into enclosure 450, accelerated while circulating inside, and expanded/ejected from a stable orbit with enclosure 450 (e.g., to hit a target, such as target 130). The swing coils 410 (also referred to as field and flux swing coils) produce an oscillating magnetic field in the center magnetic pole (and also in return yokes). For example, swing coils 410 can generate oscillating swing field 210 (FIG. 2) and swing flux 220 for accelerating electrons.

In one implementation, the top two boxes of swing coils 410 correspond to loops (windings) of electrical wire that form an inductor. As there is more than one loop, there is more than one coil. There also may be different sets of windings, e.g., there can be swing coils lying in a plane below enclosure 450, as shown. Any of the indicia for a type of coil (e.g., circle or box) lying in a same plane and at a mirrored position can be part of a same inductor.

In one aspect, the faces of magnetic core 460 are sloped so that the change in the axial magnetic field at the electron orbit (e.g., orbit 120 of device 100) and the change in the magnetic flux within the orbit satisfy the betatron condition. The sloped faces can also provide a radial magnetic field component, which focuses the electrons onto or near the middle plane. The slopes may be designed to also satisfy radial focusing stability condition.

Bias coils 412 produce a bias component of the total magnetic field at the electron orbit, in addition to the oscillating field produced by swing coils 410. For example, bias coils 412 can produce bias component 312 from FIG. 3. In one implementation, the current in bias coils 412 can change, thereby providing a change in the bias component of the magnetic field, which can provide a change in energy from pulse to pulse.

Such manipulation of bias coil operation can result in electron ejection, and thus no additional expansion coil is needed. Rapid change of bias coil current can cause rapid change of field at electron orbit. If the flux does not undergo a corresponding change (i.e., not satisfying betatron condition), then the electron's orbit can expand. To counteract a change in flux due to bias coils 412, backwound coils 440 can be placed inside of the electron orbit.

In one embodiment, distributed bias coils 412 (e.g., on return yokes) and backwound coils 440 are connected in series to an electric power supply, but with backwound coils 440 wound in the opposite direction from swing coils 410. As there are usually multiple return yokes, the bias coils can be distributed to correspond to the multiple return yokes. Backwound coils 440 can produce a reverse magnetic field inside the backwindings, which cancels any magnetic flux produced by bias coils 410 when the current in bias coils 410 changes. In this way, the betatron condition can be broken (i.e., since change in flux is no longer matching change in field), thereby leading to the electrons expanding and hitting a target.

Bias coils are not needed for embodiments relating to adjusting pulse frequency. In such embodiments, a dedicated expansion coils can be used. Additionally, for changing pulse energy, other embodiments can have dedicated expansion coils, along with bias coils. For example, an independent component (coil or less desirably electrode) can eject electrons.

Magnetic core 460 can be made of ferromagnetic metal such as iron, or ferrimagnetic compounds such as ferrites (or silicon steel). The presence of the core can increase the magnetic field of a coil by a factor of several thousand over what it would be without the core. The use of a magnetic core can concentrate the strength and increase the effect of magnetic fields produced by electric currents in the coils.

B. Circuits

Figure 5:
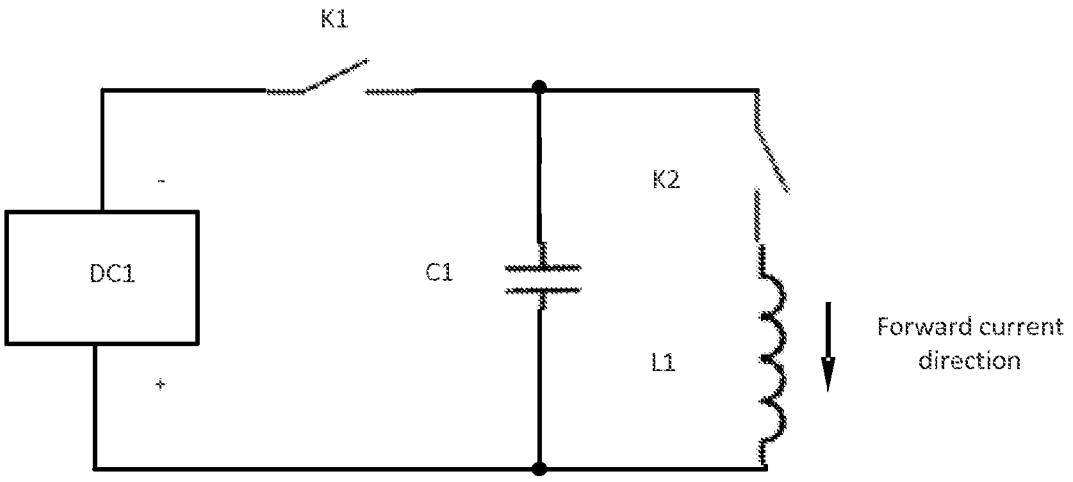
FIG. 5A shows a driving circuit 500 for swing coils L1 according to embodiments of the present invention.
FIG. 5B is a driving circuit for bias coils, and backwound coils if applicable, according to embodiments of the present invention.
Figure 5:
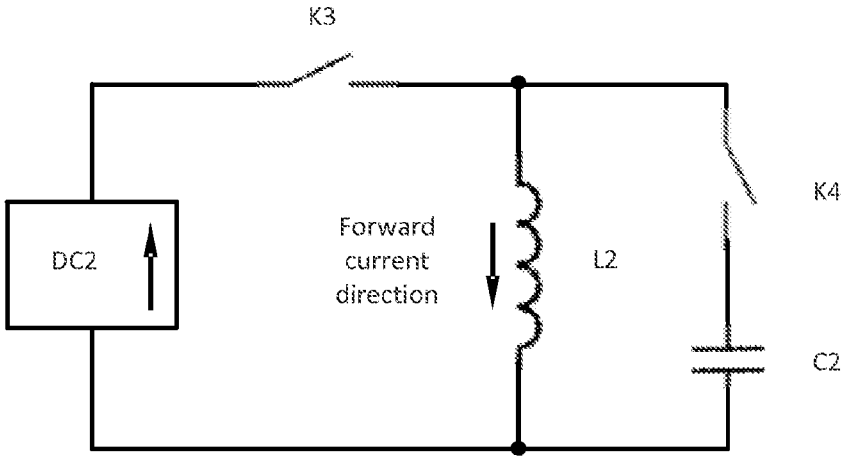

FIG. 5A shows a driving circuit 500 for swing coils L1 according to embodiments of the present invention. DC1 is a constant voltage source. K1 and K2 are switches, e.g., solid state switches, such as insulated-gate bipolar transistor (IGBT). L1 is shown as an inductor representing the swing coils. C1 is a storage device (e.g., a capacitor bank) for recovering energy stored in magnetic fields.

When K1 is closed and K2 is open, electric power supply DC1 charges the capacitor bank C1. When K1 is open and K2 is closed, L1 and C1 make a harmonic oscillator that converts energy back and forth between magnetic field energy (stored in L1) and electric field energy (stored in C1). Through control of the two switches, swing coils L1 can produce an oscillating magnetic field and an oscillating magnetic flux for circular acceleration while satisfying the betatron condition. Oscillation can be paused (e.g., when current in L1 is at zero) with no energy loss to adjust pulse frequency. More detailed description will follow.

FIG. 5B is a driving circuit 550 for bias coils L2, and backwound coils if applicable, according to embodiments of the present invention. DC2 is a constant current source. K3 and K4 are switches, e.g., solid state switches. L2 is shown as an inductor representing the bias coils, and combined with the backwound coils, if applicable. C2 is a storage device (e.g., a capacitor bank) for recovering energy stored in magnetic fields.

When K3 is closed and K4 is open, the electric power supply DC2 provides a steady state current to the coils. When K3 is open and K4 is closed, L2 and C2 make a harmonic oscillator. When K3 and K4 are both open, circuit 550 is in pause with recovered field energy stored in capacitor C2. Through control of the two switches, the bias and backwound coils can produce a bias magnetic field at electron orbit and also provide a way to eject accelerated electron. In one aspect, L2/C2 oscillation is designed to be much faster than L1/C1 oscillation. More detailed description will follow.

A forward (positive) current direction is shown for each circuit. In one aspect, a forward current corresponds to the direction of current when the power supply is connected. When the power supply is not connected and LC oscillation is occurring, current may flow in either direction, with the opposite direction being called a reverse (negative) direction.

III. Variable Rate

Some embodiments can adjust the pulse frequency of a betatron by controlling when a cycle of the swing field and flux occurs. By controlling when a cycle occurs, the pulses of electrons (and the resulting x-rays) can be varied without having to stop a session to change hardware settings. The cycles can be controlled by inserting a variable delay between two cycles, thereby providing a variable frequency. In one embodiment, energy stored in the magnetic field can be recovered and stored in a storage device (e.g., in a capacitor bank)—less dissipation by hysteresis, eddy current and ohm heating. There is no pulse-to-pulse energy change for this part of the implementation.

A. Example Operation

Figure 6:
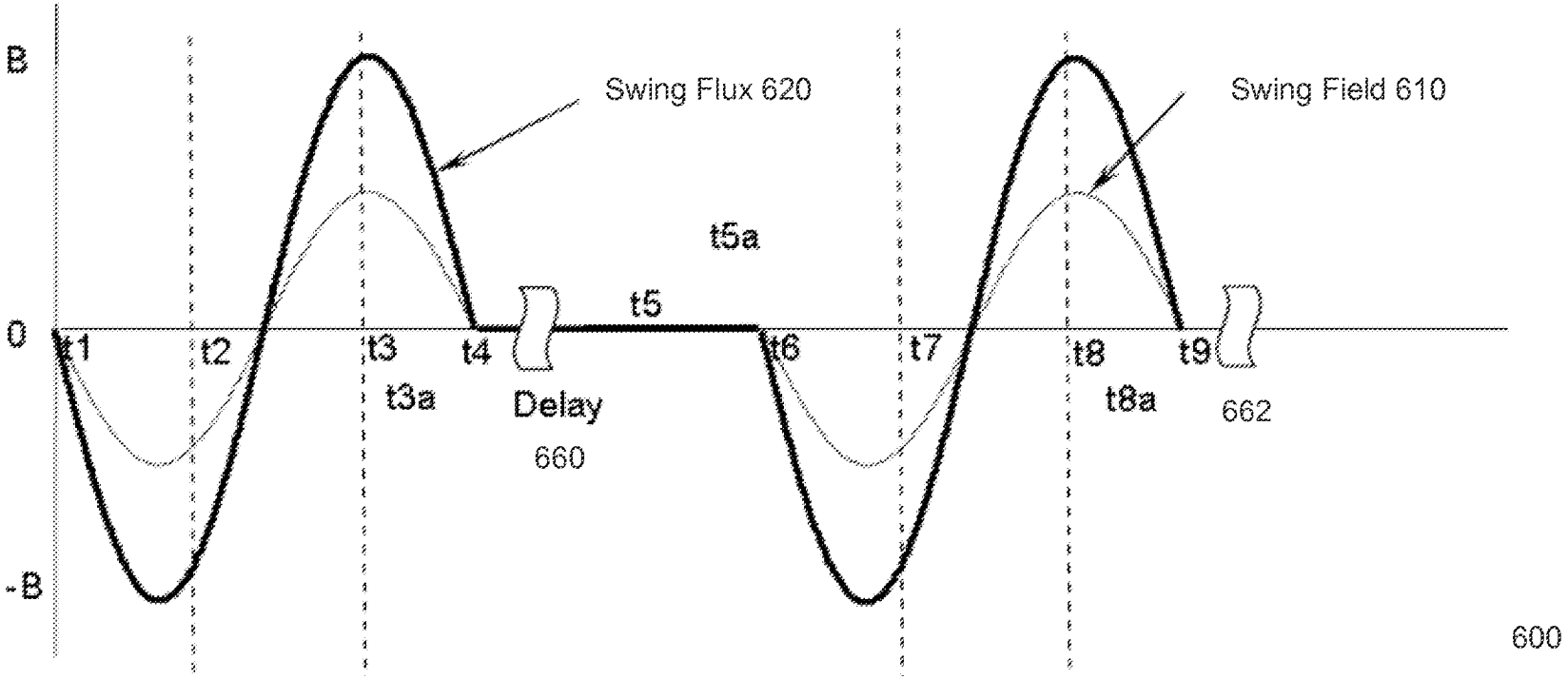
FIG. 6 shows a plot 600 of the change in swing field 610 and swing flux 620 over time for embodiments providing variable pulse frequency.

FIG. 6 shows a plot 600 of the change in swing field 610 and swing flux 620 over time for embodiments providing variable pulse frequency. As with plot 200 of FIG. 2, the horizontal axis is time, and the vertical axis shows a magnitude of the magnetic flux and field. Two cycles are shown. A delay 660 is provided between the two cycles.

Plot 600 demonstrates a sequence of manipulating switches (e.g., switches in FIG. 5A) to introduce pauses (delays), therefore adjusting pulse repetition rate. The delays can be introduced without losing field energy, besides to processes such as ohm heating. The swing coil circuit 500 of FIG. 5A is referred to in the following operation.

A first cycle (including acceleration portion and delay portion) starts at t1 and ends at t6: A new cycle starts at t6. At t1, C1 has already been fully charged to negative polarity. There is no current in L1 (swing coils) and the magnetic field at the designated electron orbit (no electrons at this time) and magnetic flux inside designated electron orbit are both zero. K1 opens and K2 closes. Negative charge in C1 builds up a negative current in L1.

At $\pi/2$ phase, the current in L1 is most negative and charge in C1 is zero. The magnetic field at the designated electron orbit (no electrons at this time) and the magnetic flux inside the designated electron orbit reaches the most negative value. This negative current continues and charges C1 in the positive direction.

At $\pi$ phase, the current in L1 is zero and the charge in C1 is most positive. The magnetic field at the designated electron orbit and the magnetic flux inside the designated electron orbit both return to zero. In one embodiment, electrons have not been injected yet, e.g., when no bias field is used. If a bias field is used, electrons may be present at this time.

At the $3\pi/2$ phase (t3), the current in L1 is most positive, and the charge in C1 is zero. The magnetic field at the electron orbit and magnetic flux inside electron orbit reaches the most positive value. This positive current continues and charges C1 in the negative direction. The electrons can be ejected from the stable electron orbit.

At $2\pi$ phase (t4), L1 and C1 have finished all $2\pi$ phase of a harmonic oscillation. Current in L1 is zero and charge in C1 is most negative. Magnetic field at designated electron orbit (no electrons at this time) and magnetic flux inside designated electron orbit both return to zero. All remaining energy in the harmonic oscillator is recovered and stored in capacitor C1 (initial amount minus dissipation, e.g., due to eddy current, hysteresis and ohm heating).

At t4, K2 opens so that oscillation is paused for a desired delay time 660. K1 closes after t4 to fully recharge capacitor C1 to negative polarity. The next acceleration cycle starts at t6. If no delay is needed, t4=t6. Operation from t6 to t9 is similar to that from t1 to t4.

The oscillation provides magnetic field swing and magnetic flux swing that is needed for electron acceleration, satisfying Betatron condition. Electrons can injected shortly after $\pi$ phase, if there is no bias magnetic field (as in this example), and ejected at $3\pi/2$ phase. Electrons can be injected after $\pi/2$ phase, if there is a bias magnetic field (as in example of FIG. 8), and ejected at $3\pi/2$ phase. Delay 660 can be set in a variety of ways and can different from delay 662. For example, a controller can have software and/or hardware that stores the current delay value. The controller can then be configured to provide open and close signals for the switches, according to methods described herein. As another example, each switch can store the delay value and be configured to operate based on hardware and/or software that is part of the switch, or switch apparatus.

B. Method

Figure 7:
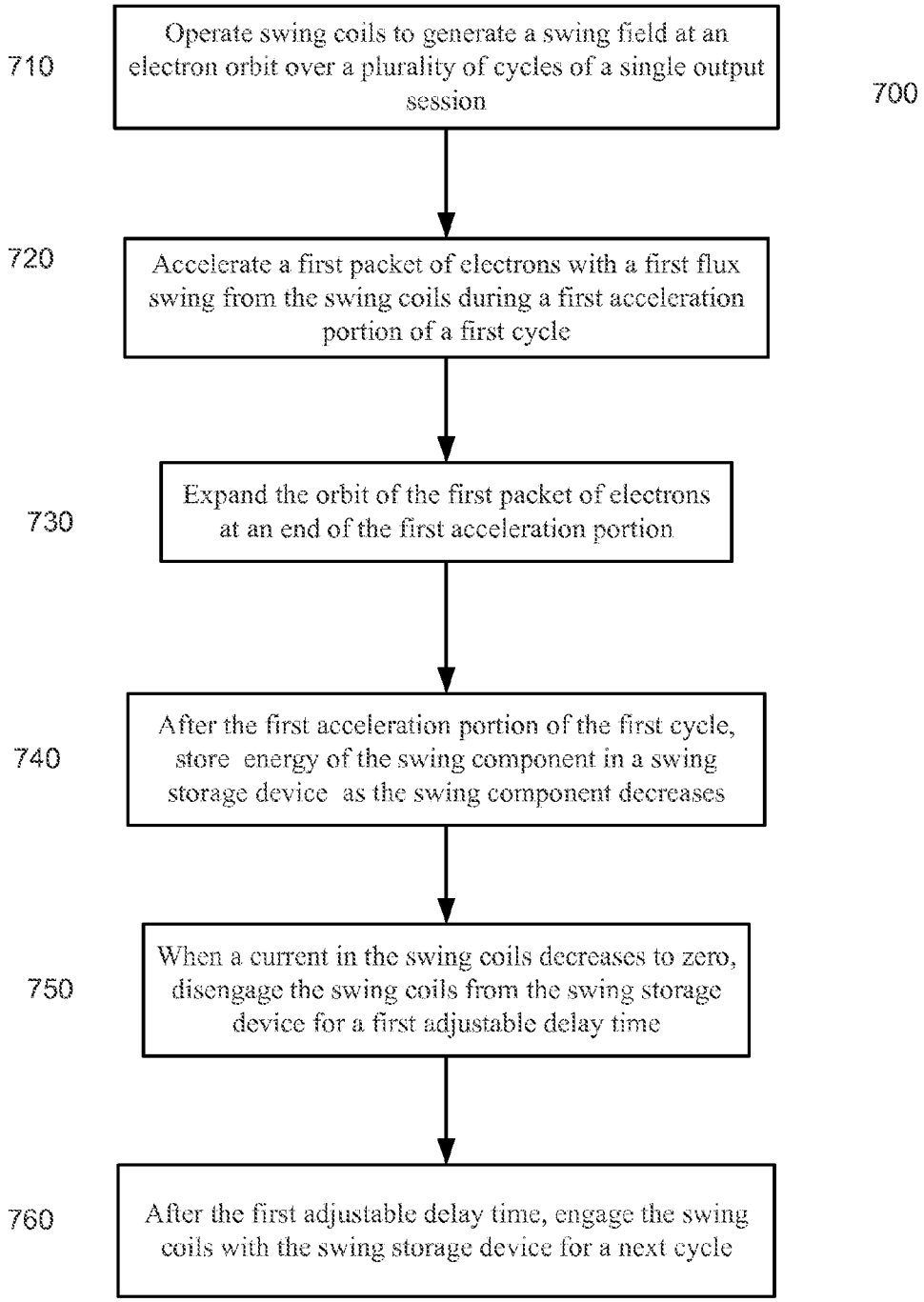
FIG. 7 is a flowchart of a method of operating a betatron device having a swing coil for accelerating electrons to provide electron pulses at adjustable cycle rates.

FIG. 7 is a flowchart of a method of operating a betatron device having a swing coil for accelerating electrons to provide electron pulses at adjustable cycle rates. Method 700 may be implemented using circuit 500 of FIG. 5, and can provide the functionality described in FIG. 6. In one embodiment, a controller (e.g., using any combination of hardware and software) can control the operation of switches to accomplish the desired operation for method 700 and other methods described herein.

At block 710, the swing coils are operated to generate a swing component of a total magnetic field at the electron orbit. The swing coils also generate a swing in magnetic flux within the electron orbit. The magnetic flux and total magnetic field are generated over a plurality of cycles of a single output session. The cycles may be cycles as shown in FIG. 6.

At block 720, a first packet of electrons is accelerated with a first swing in flux subject to the total magnetic field during a first acceleration portion of a first cycle of the plurality of cycles. The first swing is generated using the swing coils. The betatron condition can be satisfied during the acceleration portion. The electrons can be injected as packets for each cycle. In one embodiment, the swing component reaches a maximum at an end of the first acceleration portion.

At block 730, an electron orbit of the first packet of electrons is expanded at an end of the first acceleration portion. The expansion can act as a way to eject the electrons from a stable orbit and have the electrons hit a target (e.g., target 130 of FIG. 1). In one embodiment, bias coils can be used to expand the orbit from a stable electron orbit.

At block 740, after the first acceleration portion of the first cycle, energy of the swing component is stored in a swing storage device as the swing component decreases. In one embodiment, the swing storage device is one or more capacitors. The swing coils can be engaged and disengaged from the swing storage device (e.g., capacitors) using a switch (e.g., K2 of circuit 500). In one implementation, the switch is open between cycles and closed during a cycle.

At block 750, when a current in the swing coils decreases to zero, the swing coils are disengaged from the swing storage device for a first adjustable delay time. In one embodiment, while the swing coils are disengaged (e.g., via a switch) from the swing storage device, the swing storage device can be charged with a power supply (e.g., DC1 of second 500) such that the swing component has a same amplitude for each of the cycles.

At block 760, after the first adjustable delay time, the swing coils are engaged with the swing storage device for a next cycle. In various embodiments, the delay between each cycle can be the same, all be different, or some the same and some different. The energy is stored in the storage device during the delay, and is ready to be used to increase the magnetic field by sending current to the coils when the next cycle is to occur.

As described above, magnetic energy from the swing coils can be recovered during each cycle. In one embodiment, after acceleration portions of each of the plurality of cycles, the energy of the swing component is stored in the swing storage device as the swing component decreases. For example, the energy in L1 of circuit 500 can be recovered and storage device C1. The electron orbit of the current packet of electrons can be expanded at the end of the current acceleration portion, e.g., as the energy of the swing component is stored in the swing storage device. When the current in the swing coils decreases to zero, the swing coils can be disengaged (e.g., using switch K2 of circuit 500) from the swing storage device for the first adjustable delay time. And, after the first adjustable delay time, the swing coils can be re-engaged with the swing storage device for the next cycle. In this manner, the single frequency can be adjusted based on the first adjustable delay time.

In some embodiments, the swing coils can be operated at various phases of the cycle in a similar manner as described for FIG. 6. For example, during a first phase of the first cycle (e.g., from zero phase to $\pi/2$ phase), a first current polarity (e.g., negative current) in the swing coils can be increased using capacitor(s) charged to have a first charge polarity (e.g., negative charge present at t1). During a second phase (e.g., from $\pi/2$ to $7\pi$), the capacitor(s) can be charged to have a second charge polarity using the first current polarity in the swing coils. During a third phase (e.g., from $\pi$ to $3\pi/2$), a second current polarity (e.g., positive charge) can be increased in the swing coils using the capacitor(s) charged to have the second charge polarity. During a fourth phase (e.g., from $3\pi/2$ to $2\pi$), the capacitor(s) can be charged to have the first charge polarity using the second current polarity in the swing coils.

C. Variable Rate with Bias

A bias field can be combined with embodiments for providing adjustable pulse frequency. With a bias magnetic field, electrons can be injected between $\pi/2$ and $\pi$ phase and still ejected at $3\pi/2$ phase. The bias magnetic field intensity affects the final electron energy. A backwound coil can be used to counteract the flux caused by changes in the bias field.

Figure 8:
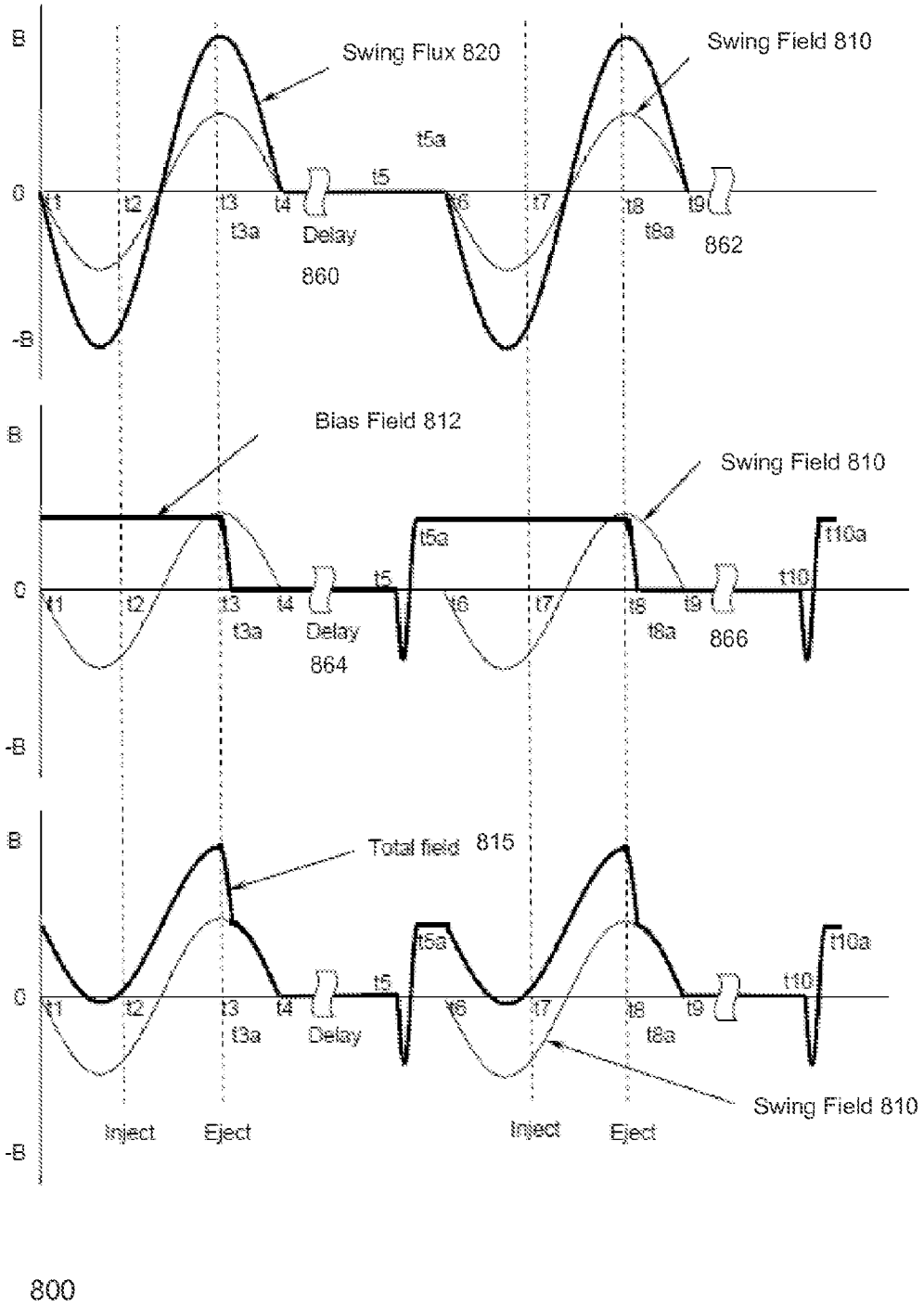
FIG. 8 shows a plot 800 of the change in swing field 810 and swing flux 820 over time for embodiments providing variable pulse frequency using a bias field 812.

FIG. 8 shows a plot 800 of the change in swing field 810 and swing flux 820 over time for embodiments providing variable pulse frequency using a bias field 812. Plot 800 is broken into three sections, with the top section being equivalent to FIG. 6. The second section shows bias field 812 for each cycle, with a delay between each cycle. The third section shows the change in total field 815 (combination of swing field 810 and bias field 812) over time.

The operation of the swing coils can proceed in a similar fashion as for FIG. 6. In the same cycle that starts at t1 and ends at t6, bias coils (and backwound coils if used) can be controlled to provide a bias field and a way of ejecting the electrons. For example, as described above, the current to the bias coils can be reduced to expand orbit of the electrons, thereby providing ejection. The bias coil circuit 550 of FIG. 5B is referred to in the following operation.

At t1, K3 is closed and K4 is open. There is full positive current in L2 and there is no charge stored in C2. There is a positive bias magnetic field at the designated electron orbit (no electrons at this time). Swing coils L1 oscillation is at zero phase and has no contribution to magnetic field. The total magnetic field at designated electron orbit equals the bias magnetic field.

At $\pi/2$ phase of the swing coil oscillation, total magnetic field 815 (bias field plus field from swing coil) at designated electron orbit is negative. As shown, total field 815 is just barely negative. In other embodiments, total field 815 could be positive during the entire cycle, as long as low peak of energy is smaller than required field for containing initial electrons, which are injected at tens of keV.

At t2, when total magnetic field 815 at the designated electron orbit is slightly positive, electrons are injected from an electron gun inside the vacuum enclosure (not shown) when total magnetic field 815 satisfies the initial Betatron condition. Electrons injected with initial energy and momentum will circle on designated orbit under this slightly positive total magnetic field.

At t3, swing coil oscillation reaches $3\pi/2$ phase and electrons have been accelerated to maximum energy and are ready for ejection. K3 opens and K4 closes at the same time, thereby disconnecting the bias coils from a bias power supply. The positive current in L2 continues and this current negatively charges C2, thereby storing energy of the bias component in a bias storage device as the bias component decreases. L2/C2 oscillation can be much faster than L1/C1 oscillation so that changes in bias field 812 can be implemented quickly. Current in L2 decreases rapidly resulting in reduced bias field. Total magnetic field at electron orbit becomes too weak to satisfy the betatron condition, and the actual electron orbit expands beyond the designated electron orbit until they hit a metal target inside the vacuum enclosure (not shown) to produce x-ray radiation.

At t3*a*, L2 current reaches zero and C2 is negatively charged. K4 opens and K3 remains open. All energy previously stored in L2 is now stored in C2 (less dissipation). Bias field 812 becomes zero and total magnetic field 815 at the designated electron orbit equals swing field 810.

From t3 to t3*a*, magnetic flux 820 inside designated electron orbit has only decreased slightly due to L1/C1 oscillation. The combined contribution of bias coils and backwound coils to magnetic flux inside designated electron orbit can always be made to be zero so that electrons do not lose energy due to ejection.

After t3*a*, both K3 and K4 remain open until after the desired delay 864. Delay 864 can be different from delay 860, as can delays 862 and 866. The amounts of delay can be adjusted to produce desired pulse repetition rate.

At t5, K4 closes and K3 remains open. L2/C2 finishes its remaining oscillation ($\pi/2$ to $2\pi$). First C2's negative charge reduces and L2 builds a negative current, then this negative current continues and charges C2 positively. Then C2's positive charge reduces and L2 builds a positive current.

AT t5*a*, all energy previously stored in C2 at t5 has been put back to L2 as a positive current. K3 closes and K4 opens. The positive current in L2 is now sustained by the electric power supply DC2. The next cycle starts at t6, and all coils are at the same settings as at t1. In this example, delay 864 would depend on how much before the next cycle is bias field 812 to be established, which can depend on the L2/C2 oscillation rate relative to the L1/C1 oscillation rate.

IV. Multi-Energy

Various embodiments can use and manipulate a bias field to utilize full swing of magnetic field, eject electron, and adjust accelerated energy from pulse to pulse. The bias field can be changed between cycles to provide different energy pulses. Energy can be recovered in a storage device, in a similar manner as for examples described above. This multi-energy technique can be used in addition to pulse frequency adjustment with field energy recovery.

In one embodiment, the bias magnetic field can be anywhere between zero and half of field swing amplitude. Electrons are injected when total magnetic field (bias field plus field from swing coil) satisfies an initial betatron condition. The electrons can be ejected when magnetic field and magnetic flux reach their maximum value. Controlling the bias field intensity adjusts the remaining flux swing available for acceleration between electron injection and ejection. When this is done from pulse to pulse, interlaced dual energy (or multiple energy) radiation is achieved.

A. Circuit Operation

Figure 9:
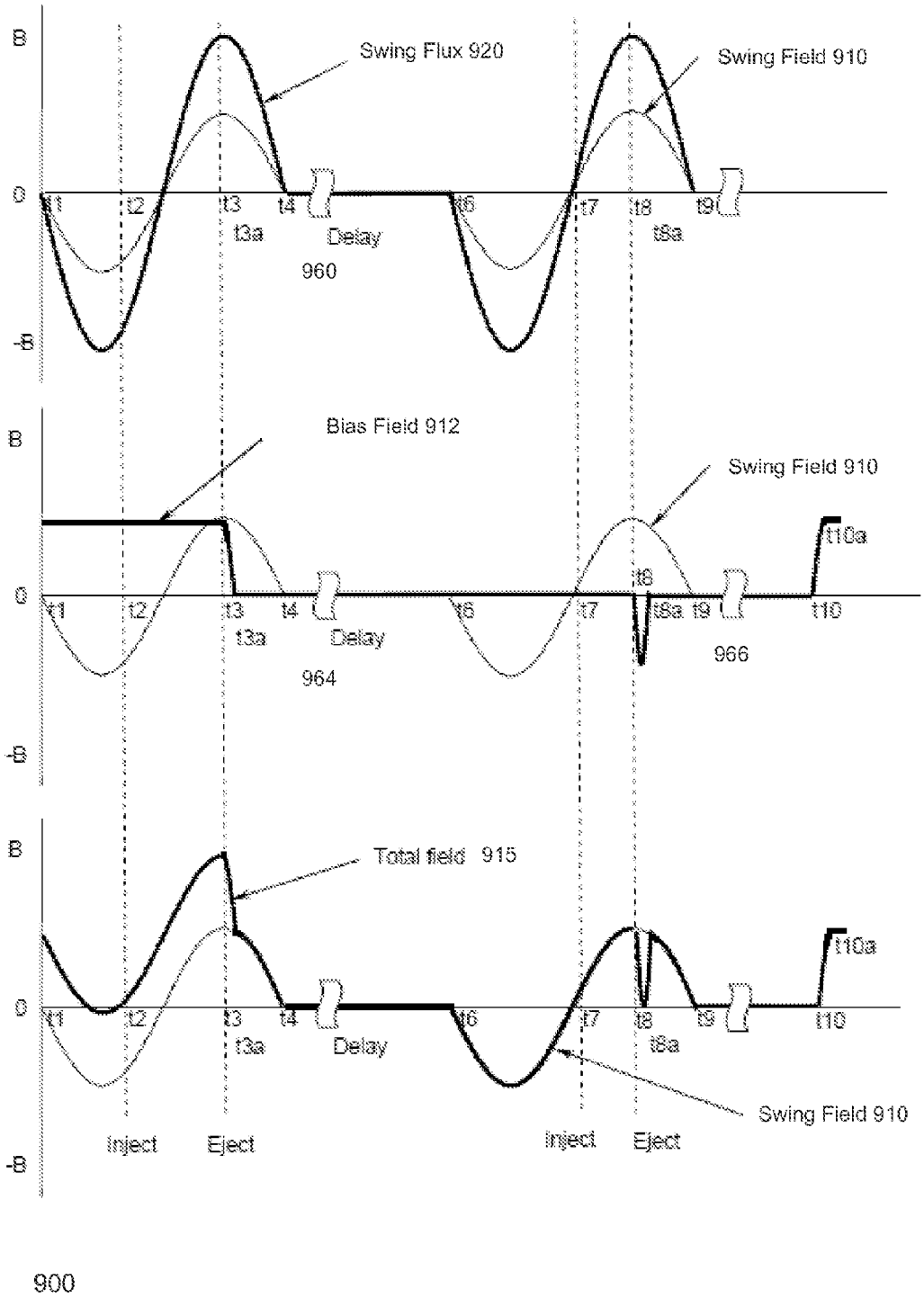
FIG. 9 shows a plot 900 of the change in swing field 910 and swing flux 920 over time for embodiments providing variable pulse frequency using a bias field 912.

FIG. 9 shows a plot 900 of the change in swing field 910 and swing flux 920 over time for embodiments providing variable pulse frequency using a bias field 912. Plot 900 specifically demonstrates interlaced pulse dual energy operation, but more than two energies could be achieved, and the energy can follow any pattern (e.g., not necessarily a repeat of the two energies). As depicted, the betatron accelerates a first group of electrons to a higher energy; and after a desired delay, the betatron accelerates a second group of electrons to a lower energy. After a desired delay, a new cycle is started. The first group of higher energy electrons produce a higher energy x-ray pulse and the second group of lower energy electrons produce a lower energy x-ray pulse.

The operation of the swing coils is similar as for FIG. 6. In the example shown, each bias/backwound coil (L2/C2) oscillation cycle contains two field/flux swing (L1/C1) oscillation-delay cycles. The cycle from t1 to t4 is for higher energy and the cycle from times t6 to t9 is for lower energy, with a desired delay between pulses. From t1 to t6, the swing coil oscillation cycle starts for generating a higher energy pulse, followed by desired delay. Thus, each double cycle can be considered as including higher energy acceleration, delay, lower energy acceleration, and delay. The bias coil circuit 550 of FIG. 5B is referred to in the following operation.

At t1, K3 is closed and K4 is open. There is full positive current in L2 and there is no charge stored in C2. There is a positive bias field 912 at the designated electron orbit (no electrons at this time). Swing coil oscillation is at zero phase and has no contribution to magnetic field. Total magnetic field 915 at the designated electron orbit equals bias field 912.

At $\pi/2$ phase of the swing coil oscillation, total magnetic field 915 at designated electron orbit is negative.

At t2, when total magnetic field 915 at designated electron orbit is slightly positive, electrons are injected from an electron gun inside the vacuum enclosure (not shown) when total magnetic field 915 satisfies an initial betatron condition. Electrons injected with initial energy and momentum will circle on designated orbit under this slightly positive total magnetic field. Since the electrons are injected near the bottom of magnetic flux up swing period, the electrons will be accelerated to a higher energy than if no bias field was used.

At t3, the swing coil oscillation reaches $3\pi/2$ phase, and the electrons have been accelerated to the higher maximum energy and are ready for ejection. K3 opens and K4 closes at the same time. The positive current in L2 continues and this current negatively charges C2. L2/C2 oscillation can be much faster than L1C1 oscillation, as described above. The current in L2 decreases rapidly resulting in a reduced bias field 912. Total magnetic field 915 at the electron orbit becomes too weak to satisfy the betatron condition, and the actual electron orbit expands beyond designated electron orbit until they hit a metal target inside the vacuum enclosure (not shown) to produce x-ray radiation.

At t3*a*, L2 current reaches zero and C2 is negatively charged. K4 opens and K3 remains open. All energy previously stored in L2 is now stored in C2 (less dissipation). Field bias becomes zero and total magnetic field at designated electron orbit equals the contribution from field/flux swing coil.

From t3 to t3*a*, magnetic flux 890 inside designated electron orbit has only decreased slightly due to L1/C1 oscillation. The combined contribution of bias coils and backwound coils to magnetic flux inside designated electron orbit can always be made to be zero so that electrons do not lose energy due to ejection. After t3*a*, both K3 and K4 remain open until electron ejection of next pulse (lower energy pulse).

From t6 to t10*a*, a swing coil oscillation cycle starts for generating a lower energy pulse, followed by desired delay. At t6, both K3 and K4 remain open. C2 remains negatively charged and there is no current in L2. Bias field 912 is zero. Total magnetic field 915 at at the designated electron orbit equals the contribution from swing filed 910.

At t7, when total magnetic field 915 at the designated electron orbit is slightly positive, electrons are injected from an electron gun inside the vacuum enclosure (not shown) when total magnetic field 915 (only contribution from swing coil because bias field is zero) satisfies an initial betatron condition. Since the electrons are injected about halfway into the magnetic flux up swing period (i.e., halfway between $\pi/2$ and $3\pi/2$, namely $\pi$), the electrons will be accelerated to a lower energy. It should be noted that t7 for interlaced dual energy operation is later than t7 in fixed energy operation described for FIG. 8.

At t8, the swing coil oscillation reaches $3\pi/2$ phase, and the electrons have been accelerated to the lower maximum energy and are ready for ejection. K3 remains opens but K4 closes. The negative charge in C2 starts to flow through L2, and L2 build up negative current. Negative current in L2 continues when C2 is completely discharged. This current positively charges C2. Negative current in L2 can build up (increase) rapidly resulting in a negative bias field 912. The increase in negative current is rapid when L2/C2 oscillation is much faster than L1/C1 oscillation. Total magnetic field 915 at the electron orbit becomes too weak to satisfy the betatron condition, and the actual electron orbit can expand beyond designated electron orbit until they hit a metal target inside the vacuum enclosure (not shown) to produce x-ray radiation.

At t8*a*, L2 current reaches zero and C2 is positively charged. K4 opens and K3 remains open. All energy previously stored in L2 is now stored in C2 (less dissipation). Field bias 912 becomes zero and total magnetic field 915 at the designated electron orbit equals the contribution from swing field 910. From t8 to t8*a*, magnetic flux 920 inside the designated electron orbit has only decreased slightly due to L1/C1 oscillation.

After the desired delay at t10, K4 closes but K3 remains open. Positive charge stored in C2 builds up a positive current in L2. At t10*a*, all energy previously stored in C2 at t10 has been put back to L2 as a positive current. K3 closes and K4 opens. The positive current in L2 is now sustained by the electric power supply DC2 and ready for next higher energy pulse.

Accordingly, after the first acceleration portion of the first cycle (t3), the bias coils are disconnected from a bias power supply. The energy of the bias component is stored in a bias storage device as the bias component decreases between t3 and t3*a*. When a current in the bias coils decreases to zero (t3*a*), the bias coils are disengaged from the bias storage device for a second adjustable delay time. The delay can be long, e.g., from t3*a* to t8. In another embodiment, the delay 964 can be zero, and the second adjustable delay refers to delay 966. However, in such a case, bias field 912 is not used for ejection in the manner depicted in plot 900. However, when bias filed (component) 912 is not to be used for the next cycle, delay 964 can be adjusted as depicted, and would be longer than delay 960.

B. Method

Figure 10:
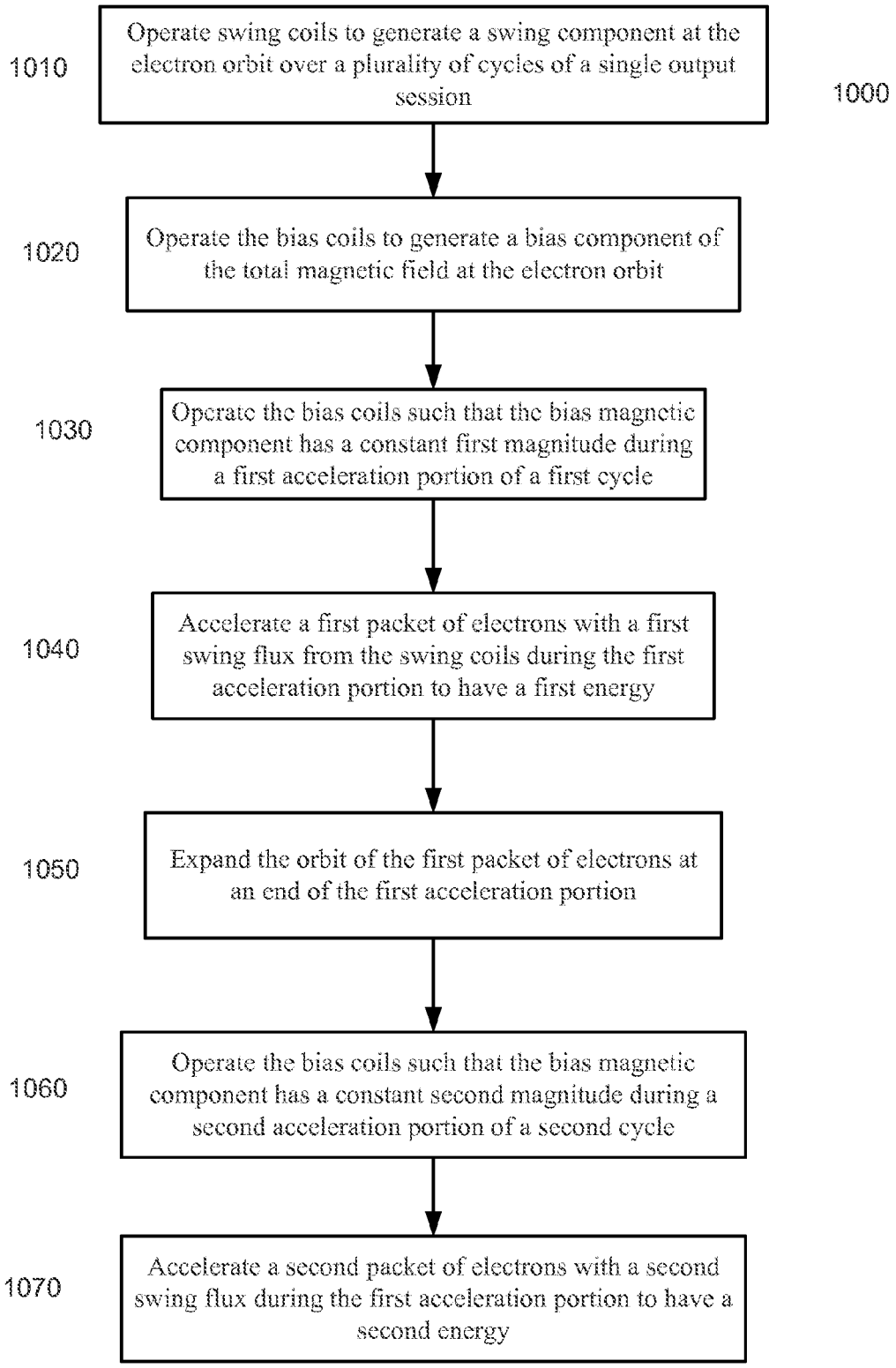
FIG. 10 is a flowchart of a method 1000 of operating a betatron device having swing coils for accelerating electrons and having bias to provide electron pulses at different energies.

FIG. 10 is a flowchart of a method 1000 of operating a betatron device having swing coils for accelerating electrons and having bias to provide electron pulses at different energies.

At block 1010, the swing coils are operated to generate a swing component of a total magnetic field at the electron orbit. The swing coils also generate a swing in magnetic flux within the electron orbit. The swing component can have a same amplitude for each of a plurality of cycles of a single output session. For example, a power supply can recharge a storage device to have a same charge between cycles, as is described for method 700.

At block 1020, the bias coils are operated to generate a bias component of the total magnetic field at the electron orbit. The bias coils can be situated as shown in FIG. 4. The bias component can vary over time, e.g., as shown in FIG. 9.

At block 1030, the bias coils are operated such that the bias magnetic component has a constant first magnitude during a first acceleration portion of a first cycle of the plurality of cycles. In one embodiment, the constant first magnitude is achieved with a power supply, e.g., a constant current power supply.

At block 1040, a first packet of electrons is accelerated with a first swing in flux subject to the total magnetic field during the first acceleration portion of the first cycle to have a first energy. The first swing is generated by the swing coils. In one aspect, the electrons are injected into the betatron with sufficient energy to correspond to the total magnetic field present at the time of injection so that the betatron condition is satisfied.

At block 1050, an electron orbit of the first packet of electrons is expanded at an end of the first acceleration portion. At the end of the first acceleration portion, the bias coils can disconnected from a bias power supply (e.g., DC2 of circuit 550) and connected to a bias storage device (e.g., C2 of circuit 550), thereby causing the first packet of electrons to expand from a stable orbit. When a current in the bias coils decreases to zero (e.g., at time t3*a* or time t8*a*), the bias coils can disconnected from the bias storage device to provide a delay at either part of the L2/C2 oscillation. The bias coils can be kept disengaged from the bias storage device for a first adjustable delay time (e.g., delay 964 or delay 966). Backwound coils can be connected to the bias storage device at the end of the first acceleration portion to produce an opposite flux within the electron orbit.

At block 1060, the bias coils are operated such that the bias magnetic component has a constant second magnitude during a second acceleration portion of a second cycle of the plurality of cycles. The second magnitude is different than the first magnitude (e.g., higher or lower). In one embodiment, the second magnitude is zero and the first magnitude is some positive value. In another embodiment, the second magnitude and the first magnitude are both positive.

At block 1070, a second packet of electrons is accelerated with a second swing in flux subject to the total magnetic field during the second acceleration portion of the second cycle to have a second energy. The second energy is different than the first energy, and thus energies of different pulses are provided during a single output session. In one embodiment, the second magnitude is less than the first magnitude, and the second energy is less than the first energy. The swing coils and the bias coils can operated such that the cycles with the first accelerated electron energy and the second accelerated electron energy alternate.

As in depicted in plot 900, the first adjustable delay time (delay 964) can be until an end (t8) of the second acceleration portion of the second cycle, and the constant second magnitude of the bias magnetic component can be zero during the second acceleration portion of the second cycle. At the end of the second acceleration portion of the second cycle, the bias coils can be connected to the bias storage device to expand the second packet of electrons from a stable orbit. After the current in the bias coils reaches a peak reverse value (e.g., minimum value between t8 and t8*a*) and then decreases to zero (t8*a*) and in advance of a third cycle, a forward current in the bias coils is increased with the bias storage device (e.g., from t10 to t10*a*).

When the bias storage device is depleted and the forward current reaches a peak (t10*a*), the bias coils can be disconnected from the bias storage device and connected to the bias power supply. The bias coils can be operated with the power supply such that the bias magnetic component has a constant third magnitude during a third acceleration portion of the third cycle. The third magnitude can be the same or different from the first magnitude and the second magnitude.

In one embodiment, a delay (e.g., delay 966) can be implemented by disconnecting the bias coils from the bias storage device when the current in the bias coils reaches a peak reverse value and then decreases to zero. The bias coils can be kept disengaged from the bias storage device for a second adjustable delay time. The bias coils can then be connected to the bias storage device to increase the forward current in the bias coils in advance of the third cycle.

C. More Energy Levels

It should be noted that although this example provides interlaced dual-energy operation, more interlaced energy levels can be achieved in similar way—with each bias magnetic field value in acceleration period corresponding to an energy level. Examples for providing more than two energies are provided below.

In one embodiment, to obtain variable energy levels, one can change the charge on C1 between cycles. For example, to have a lower energy pulse, one can reduce the charge on C1 until the desired value is reached. Then, when C1 is engaged with L1 for the next cycle, the peak values will be at a lower energy. However, certain energy is lost and would need to be recovered via the power supply when a higher energy is desired. Thus, although this is not efficient, more energy levels could be obtained. When a higher energy level is needed next time, the power supply would deliver the additional voltage to increase the charge on the storage device. C1 could be disconnected from the power supply before a maximum charge is reached, if the maximum voltage is not desired.

Additionally, multiple swing power supply switches could be used to select among multiple power supplies for charging C1 to different charge levels based on the desired energy for a given cycle. The storage device could include subcomponents (e.g., capacitors of single capacitor bank) with multiple swing storage switches used to select among the subcomponents storage devices, where the subcomponents are selected based on the total charge stored on those selected subcomponents, and therefore the magnetic energy that is achieved during the next cycle. The change in these additional switches can occur during a delay period between cycles.

In another embodiment, multiple swing storage switches and swing storage devices (e.g., capacitors) can be used with one power supply. One example would be recovering field energy into a first swing storage device (e.g., one subcomponent of an array) and a second swing storage device (in parallel), disconnecting them, connecting the second swing storage device with a previously empty third swing storage device in parallel, and driving the coil thereafter with the second swing storage device and the third swing storage device. The various storage subcomponents can have the same or different storage capacity, e.g., capacitances. This way an embodiment can have about half the coil current but the same oscillation time constant, which can be important. Other variations of switches and storage device can be used to provide a storage device of different charge for different cycles, and thus provide different energies. Additionally, switches can be located to charge specific storage devices.

Additionally, the swing power supply can be adjusted between sessions to achieve a lower/higher energy by changing swing coil current and therefore magnetic field at designated electron orbit and magnetic flux swing inside the designated electron orbit. Also, the bias power supply can be adjusted so to provide different energy shifts. For interlaced dual energy operation, the lower energy acceleration utilizes approximately half of the upswing period. The higher energy can be further controlled by adjusting bias coil current. A larger bias coil current leads to utilization of a larger portion of upswing period and therefore achieving higher energy.

Embodiments can also use multiple bias power supplies to provide different constant voltages during different acceleration portions. For example, at time t10 of plot 900 a different storage device (than the one used for the previous cycle) could be chosen to increase the bias component a different amount, and then have a corresponding power supply selected at time t10*a*.

V. Dose Variation

It may also be desirable to control radiation output from pulse to pulse. The amount of X-rays output from the target (e.g., target 130) is dependent on energy. The amount of x-rays is also proportionate to the amount of electrons in packet, which is dependent on the amount of electrons injected. To obtain variable amounts of radiation output at a given energy, embodiments can control the length of injection time of the injection gun to adjust radiation output. Such a control of the injection time can be performed in combination with embodiments that provide variable energy pulses and/or variable cycle frequency.

Typically, there is a maximum length of time period that electrons supplied from the electron gun can be trapped in orbit for acceleration. When less radiation output is desired, the electron gun can supply electrons for a time period shorter than that maximum length. As a result, the amount of trapped and accelerated electrons is smaller than capacity. And, X-ray radiation output will be proportionally less.

Figure 11:
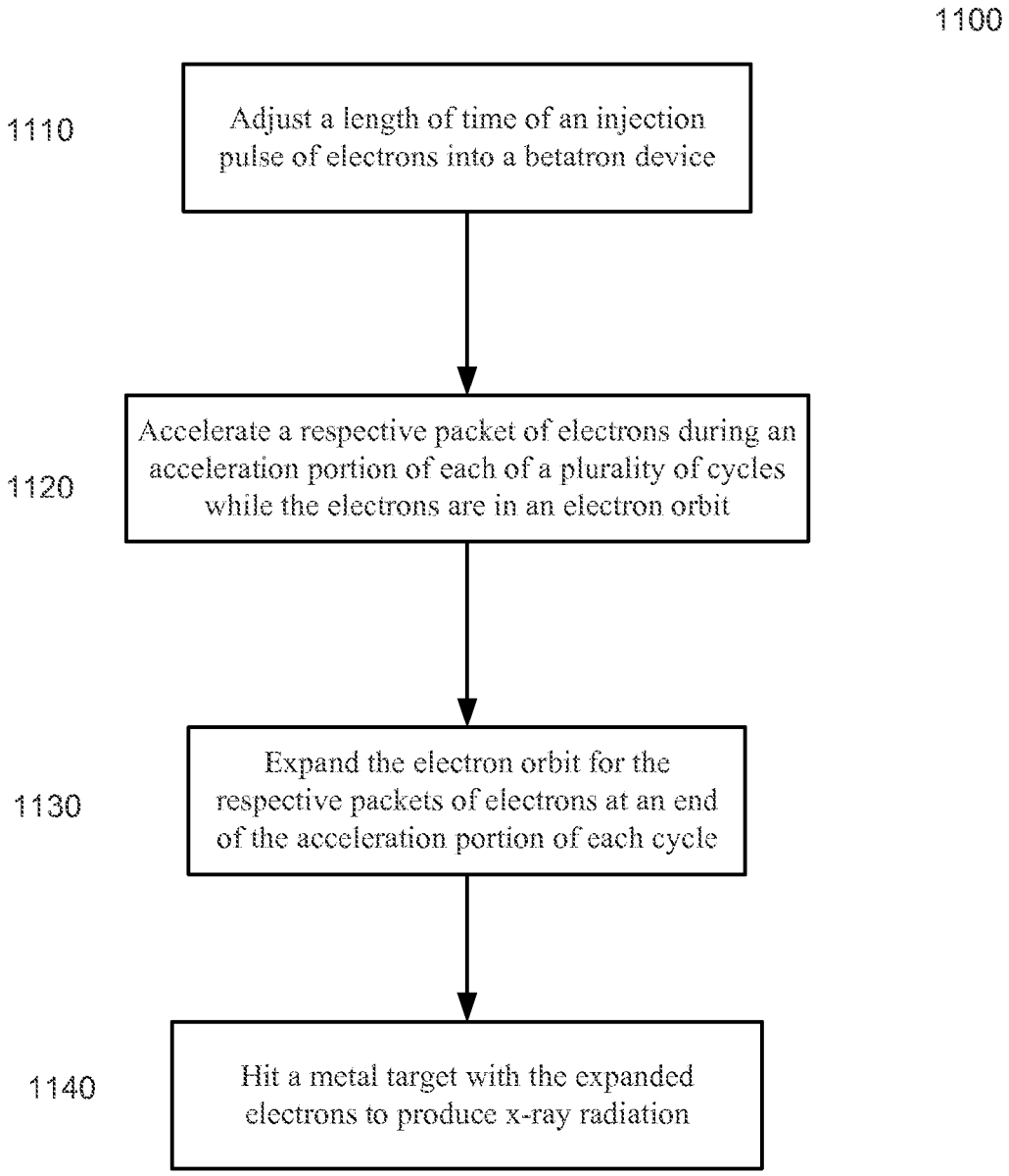
FIG. 11 is a flowchart illustrating a method of controlling an amount of x-ray radiation dose emitted by a betatron device according to embodiments of the present invention.

FIG. 11 is a flowchart illustrating a method 1100 of controlling an amount of x-ray radiation dose emitted by a betatron device according to embodiments of the present invention. Method 1100 may be combined with any of the other methods described herein.

At block 1110, a length of time of an injection pulse of electrons into a betatron device is adjusted. In one embodiment, the length of time can be set at the beginning of an output session. In another embodiment, the length of time can vary for each cycle. The input time can be provided via a user interface, configuration data, or any other suitable manner.

At block 1120, a respective packet of electrons are accelerated during an acceleration portion of each of a plurality of cycles while the electrons are in an electron orbit. Each packet of electrons can be accelerated via any of the methods described above.

At block 1130, the electron orbit for the respective packets of electrons is expanded at an end of the acceleration portion of each cycle. The electron orbit can be expanded with bias coils or dedicated expansion coils.

At block 1140, a metal target is hit with the expanded electrons to produce x-ray radiation. The length of time of the injection pulse is adjusted based on a desired amount of dose output for the radiation beam. The betatron device can be calibrated so that the injection time can be determined from a desired amount of dose output. In various embodiments, the metal target could be tungsten, copper, or tantalum.

It should be noted that unlike RF linear accelerators, in betatrons, the duration of x-ray pulse is not related to the length of period in which the gun supplies electrons. The length of period in which the gun supplies electrons affects how many electrons are trapped and accelerated—and therefore the total amount of x-ray radiation in one pulse. The length of x-ray pulse is determined by ejection parameters. For example, a larger magnetic field change at ejection time results in quicker actual electron orbit expansion and quicker electron ejection. A smaller magnetic field change at ejection results in a longer duration for electrons to expand and hit the metal target—and therefore longer x-ray pulse.

The specific details of particular embodiments may be combined in any suitable manner without departing from the spirit and scope of embodiments of the invention. However, other embodiments of the invention may be directed to specific embodiments relating to each individual aspect, or specific combinations of these individual aspects.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

A recitation of "a", "an" or "the" is intended to mean "one or more" unless specifically indicated to the contrary.

All patents, patent applications, publications, and descriptions mentioned here are incorporated by reference in their entirety for all purposes. None is admitted to be prior art.

What is claimed is:

1. A method of operating a betatron device having swing coils for accelerating electrons and having bias coils to provide electron pulses at different energies, the method comprising:

operating the swing coils to generate a swing component of a total magnetic field at the electron orbit over a plurality of cycles, the electron orbit being a circular path in which accelerated electrons travel;

operating the bias coils to generate a bias component of the total magnetic field at the electron orbit;

operating the bias coils such that the bias magnetic component has a constant first magnitude during a first acceleration portion of a first cycle of the plurality of cycles;

accelerating, with the swing coils, a first packet of electrons with a first swing in flux subject to the total magnetic field during the first acceleration portion of the first cycle to have a first energy, wherein the first packet of electrons is in a stable orbit during the first acceleration portion of the first cycle;

expanding an electron orbit of the first packet of electrons at an end of the first acceleration portion;

operating the bias coils such that the bias magnetic component has a constant second magnitude during a second acceleration portion of a second cycle of the plurality of cycles, the second magnitude being different than the first magnitude; and accelerating, with the swing coils, a second packet of electrons with a second swing in flux subject to the total magnetic field during the second acceleration portion of the second cycle to have a second energy, the second energy being different than the first energy.

2. The method of claim 1, wherein expanding the electron orbit of the first packet of electrons includes:

decreasing a current in the bias coils at the end of the first acceleration portion of the first cycle such that:

the total magnetic field at the electron orbit is reduced, the first packet of electrons expand from the stable orbit, and the first packet of electrons hits a metal target to produce x-ray radiation at the first energy.

3. The method of claim 1, wherein the second magnitude is less than the first magnitude, and the second energy is less than the first energy.

4. The method of claim 1, further comprising:

operating the swing coils and the bias coils such that the cycles with the first accelerated electron energy and the second accelerated electron energy alternate.

5. The method of claim 1, further comprising:

at the end of the first acceleration portion:

disconnecting the bias coils from a bias power supply, and connecting the bias coils to a bias storage device, thereby causing the first packet of electrons to expand from the stable orbit;

when a current in the bias coils decreases to zero, disconnecting the bias coils from the bias storage device; and keeping the bias coils disengaged from the bias storage device for a first adjustable delay time.

6. The method of claim 5, further comprising:

connecting backwound coils to the bias storage device at the end of the first acceleration portion, the backwound coils connected in series with the bias coils and producing an opposite flux within the electron orbit.

7. The method of claim 5, wherein the first adjustable delay time is until an end of the second acceleration portion of the second cycle, wherein the constant second magnitude of the bias magnetic component is zero during the second acceleration portion of the second cycle, the method further comprising:

at the end of the second acceleration portion of the second cycle, connecting the bias coils to the bias storage device to expand the second packet of electrons from a stable orbit; and after the current in the bias coils reaches a peak reverse value and then decreases to zero and in advance of a third cycle, increasing a forward current in the bias coils with the bias storage device;

when the bias storage device is depleted and the forward current reaches a peak:

disconnecting the bias coils from the bias storage device, and connecting the bias coils to the bias power supply, and operating the bias coils with the power supply such that the bias magnetic component has a constant third magnitude during a third acceleration portion of the third cycle.

8. The method of claim 7, further comprising:

when the current in the bias coils reaches a peak reverse value and then decreases to zero, disconnecting the bias coils from the bias storage device;

keeping the bias coils disengaged from the bias storage device for a second adjustable delay time; and connecting the bias coils to the bias storage device to increase a forward current in the bias coils in advance of the third cycle.

9. A betatron device for providing electron pulses at different energies, the betatron device comprising:

a vacuum enclosure for electrons to orbit during acceleration portions of respective cycles;

magnetic cores that conduct and contain magnetic flux and that shape magnetic fields at the electron orbit;

swing coils configured to generate a swing in magnetic flux within the electron orbit and a swing component of a total magnetic field at the electron orbit over a plurality of cycles of a single output session;

bias coils configured to generate a bias component of the total magnetic field at the electron orbit during the acceleration portions of the respective cycles;

a bias storage device selectively coupled to the bias coils via at least a bias storage switch; and a bias power supply selectively coupled to the bias coils and the bias storage device via at least a bias power switch, wherein the bias storage switch and the bias power switch are configured to disconnect the bias coils from the bias power supply and transfer energy from the bias coils to the bias storage device at a particular time during a cycle of the single output session.

10. The betatron device of claim 9, wherein the bias storage switch and the bias power switch are further configured to:

provide a first bias coil current from the bias power supply to the bias coils such that the bias magnetic component has a constant first magnitude during a first acceleration portion of a first cycle of the respective cycles; and provide a second bias coil current to the bias coils such that the bias magnetic component has a constant second magnitude during a second acceleration portion of a second cycle of the respective cycles, the second magnitude being different than the first magnitude.

11. The betatron device of claim 10, wherein the constant second magnitude is zero.

12. The betatron device of claim 10, wherein the bias storage switch and the bias power switch are further configured to:

disconnect the bias coil from the bias power supply and transfer energy from the bias coils to the bias storage device at the end of the first acceleration portion, thereby expanding an orbit of first electrons.

13. The betatron device of claim 12, wherein the bias storage switch and the bias power switch further are configured to:

disengage the bias coils from the bias storage device when the bias coil current reduces to zero and keep the bias coil current at zero for the second acceleration portion;

connect the bias coils to the bias storage device to increase the reverse current in the bias coil to expand an orbit of second electrons at the end of the second accelerating portion;

disconnect the bias coils from the bias storage device when the reverse current reaches a peak value and reduces back to zero;

after a variable period of delay time, connect the bias coils to the bias storage device to increase a forward current in advance of the next cycle, and disconnect the bias coils from the bias storage device when a forward current reaches a peak value and connect the bias coils to the bias power supply to sustain a steady current.

14. The betatron device of claim 9 wherein:

the bias power supply has a first terminal and a second terminal;

the bias power switch has a first end coupled with the first terminal;

the bias coils are coupled with a second end of the bias power switch;

the bias storage switch having a first end coupled with the second end of the bias power switch, the bias power switch being in parallel with the bias coils; and the bias storage device coupled in series with the bias storage switch and coupled in parallel with the bias coils.

15. The betatron device of claim 9, further comprising:

backwound coils connected in series with the bias coils and producing an opposite flux within the electron orbit.

16. A method of operating a betatron device having a swing coil for accelerating electrons to provide electron pulses at adjustable cycle rates, the method comprising:

operating the swing coils to generate a swing component of a total magnetic field at the electron orbit over a plurality of cycles, the electron orbit being a circular path in which accelerated electrons travel;

accelerating, with the swing coils, a first packet of electrons with a first swing in flux subject to the total magnetic field during a first acceleration portion of a first cycle of the plurality of cycles;

expanding an electron orbit of the first packet of electrons at an end of the first acceleration portion;

after the first acceleration portion of the first cycle, storing energy of the swing component in a swing storage device as the swing component decreases;

when a current in the swing coils decreases to zero, disengaging the swing coils from the swing storage device for a first adjustable delay time; and after the first adjustable delay time, engaging the swing coils with the swing storage device for a next cycle.

17. The method of claim 16, wherein the swing component reaches a maximum at the end of the first acceleration portion.

18. The method of claim 16, wherein expanding the electron orbit of the first packet of electrons includes:

operating bias coils at the end of the first acceleration portion of the first cycle such that:

the total magnetic field at the electron orbit is reduced, the first packet of electrons expand from a stable orbit, and the first packet of electrons hits a metal target to produce x-ray radiation.

19. The method of claim 16, further comprising:

after acceleration portions of each of the plurality of cycles, storing energy of the swing component in the swing storage device as the swing component decreases;

expanding an electron orbit of a current packet of electrons at an end of a current acceleration portion of a current cycle;

when the current in the swing coils decreases to zero, disengaging the swing coils from the swing storage device for the first adjustable delay time; and after the first adjustable delay time, engaging the swing coils with the swing storage device for the next cycle.

20. The method of claim 16, further comprising:

while the swing coils are disengaged from the swing storage device, charging the swing storage device with a power supply such that the swing component has a same amplitude for each of the cycles.

21. The method of claim 16, wherein the swing storage device is one or more capacitors.

22. The method of claim 21, wherein the swing coils are engaged and disengaged from the one or more capacitors using a switch, wherein the switch is open between cycles and closed during a cycle.

23. The method of claim 22, wherein operating the swing coils during the first cycle includes:

during a first phase of the first cycle, increasing a first current polarity in the swing coils using the one or more capacitors charged to have a first charge polarity;

during a second phase of the first cycle, charging the one or more capacitors to have a second charge polarity using the first current polarity in the swing coils;

during a third phase of the first cycle, increasing a second current polarity in the swing coils using the one or more capacitors charged to have the second charge polarity;

during a fourth phase of the cycle, charging the one or more capacitors to have the first charge polarity using the second current polarity in the swing coils.

24. The method of claim 16, wherein the first charge polarity is a negative charge polarity and the first current polarity is a negative charge polarity.

25. The method of claim 16, further comprising:

operating bias coils to generate a bias component of the total magnetic field at the electron orbit during the first acceleration portion of the first cycle;

after the first acceleration portion of the first cycle:

disconnecting the bias coils from a bias power supply, and storing energy of the bias component in a bias storage device as the bias component decreases;

when a current in the bias coils decreases to zero, disengaging the bias coils from the bias storage device for a second adjustable delay time; and after the second adjustable delay time, engaging the bias coils with the bias storage device.

26. The method of claim 25, further comprising:

when the bias component is not to be used for the next cycle:

engaging the bias coils with bias storage device at an end of a next acceleration portion of the next cycle to expand a second packet of electrons from a stable orbit, the second adjustable delay time being longer than the first adjustable delay time when the bias component is not needed for the next cycle, and storing energy of the bias component in the bias storage device,; and when the bias component is to be used for the next cycle:

in advance of a next acceleration portion of the next cycle:

engaging the bias coils with the bias storage device after the second adjustable delay time, and subsequently disengaging the bias coils from the bias storage device and reconnecting the bias coils to the bias power supply;

at the end of the next acceleration portion of the next cycle:

disconnecting the bias coils from the bias power supply, engaging the bias coils to the bias storage device to expand the next packet of electrons from a stable orbit for x-ray generation, and storing energy of the bias component in the bias storage device.

27. A betatron device for providing electron pulses at adjustable cycle rates, the betatron device comprising:

a vacuum enclosure for electrons to orbit during acceleration portions of respective cycles;

magnetic cores that conduct and contain magnetic flux and that shape magnetic fields at the electron orbit;

swing coils configured to generate a swing in magnetic flux within the electron orbit and a swing component of a total magnetic field at the electron orbit over a plurality of cycles of a single output session;

a swing storage device selectively coupled to the swing coils via at least a swing storage switch;

a swing power switch configured to selectively couple a swing power supply to the swing coils and the swing storage device, wherein the swing storage switch is configured to engage the swing coils with the swing storage device during a cycle and to disengage the swing coils from the swing storage device for an adjustable delay time between cycles, and wherein the first power switch is configured to disconnect the swing power supply from the swing coils and the swing storage device during a cycle.

28. The betatron device of claim 27, wherein the swing storage switch is configured to disengage the swing coils from the swing storage device when a current in the swing coils is zero and the swing storage device is in a specified charge state.

29. The betatron device of claim 28, wherein the specified charge state is a peak negative charge.

30. The betatron device of claim 27, wherein the swing power switch is configured to connect the swing power supply to the swing storage device for at least a portion of the time between cycles to charge the swing storage device.

31. The betatron device of claim 27, wherein:

the swing power supply has a first terminal and a second terminal;

the swing power switch has a first end coupled with the first terminal;

the swing storage device is coupled with a second end of the swing power switch;

the swing storage switch has a first end coupled with the second end of the power switch, the swing storage switch being in parallel with the swing storage device;

the swing coils are coupled in series with the swing storage switch and coupled in parallel with the swing storage device.

32. The betatron device of claim 27, further comprising:

bias coils configured to generate a bias component of the total magnetic field at the electron orbit during the acceleration portions of the respective cycles;

a bias storage device selectively coupled to the bias coils via at least a bias storage switch; and a bias power switch configured to selectively couple a bias power supply to the bias coils and the bias storage device, wherein the bias storage switch and the bias power supply switch are configured to:

provide a first steady bias coil current from the bias power supply to the bias coils such that the bias magnetic component has a constant first magnitude during a first acceleration portion of a first cycle of the respective cycles; and provide a second steady bias coil current to the bias coils such that the bias magnetic component has a constant second magnitude during a first acceleration portion of a first cycle of the respective cycles, the second magnitude being different than the first magnitude.

33. The betatron device of claim 27, further comprising:

an electron gun that injects electrons into the vacuum enclosure for acceleration during each cycle; and a metal target that produces x-ray radiation upon impact of electrons that are expanded from the electron orbit.

34. The betatron device of claim 27, wherein a first delay time between a first pair of cycles is different than a second delay between a second pair of cycles.

35. A method of controlling an amount of x-ray radiation dose emitted by a betatron device, the method comprising:

adjusting a length of time of an injection pulse of electrons into a betatron device;

accelerating a respective packet of electrons during an acceleration portion of each of a plurality of cycles while the electrons are in an electron orbit;

expanding the electron orbit for the respective packets of electrons at an end of the acceleration portion of each cycle; and hitting a metal target with the expanded electrons to produce x-ray radiation, wherein the length of time of the injection pulse is adjusted based on a desired amount of dose output for the radiation beam.

* * * * *